US008856998B2

(12) United States Patent
Schäfer et al.

(10) Patent No.: US 8,856,998 B2
(45) Date of Patent: Oct. 14, 2014

(54) MOBILE FLOOR CLEANING MACHINE

(71) Applicant: Alfred Kärcher GmbH & Co. KG, Winnenden (DE)

(72) Inventors: Rainer Schäfer, Leutenbach (DE); Frank Nonnenmann, Schorndorf (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 0 days.

(21) Appl. No.: 13/893,945

(22) Filed: May 14, 2013

(65) Prior Publication Data

US 2013/0247313 A1 Sep. 26, 2013

Related U.S. Application Data

(63) Continuation of application No. PCT/EP2010/067492, filed on Nov. 15, 2010.

(51) Int. Cl.

| | |
|---|---|
| ***A47L 11/282*** | (2006.01) |
| ***A47L 11/40*** | (2006.01) |
| ***A47L 11/30*** | (2006.01) |

(52) U.S. Cl.

CPC ..... *A47L 11/40* (2013.01); *A47L 11/302* (2013.01); *A47L 11/282* (2013.01); *A47L 11/4061* (2013.01)

USPC ..... 15/49.1; 15/50.1

(58) Field of Classification Search

None

See application file for complete search history.

(56) References Cited

U.S. PATENT DOCUMENTS

| | | | | |
|---|---|---|---|---|
| 5,483,718 | A * | 1/1996 | Blehert et al. | 15/50.3 |
| 5,611,105 | A | 3/1997 | Blehert et al. | |

FOREIGN PATENT DOCUMENTS

| | | |
|---|---|---|
| EP | 0 705 559 | 4/1996 |
| EP | 0 910 981 | 4/1999 |

* cited by examiner

*Primary Examiner* — Monica Carter
*Assistant Examiner* — Stephanie Berry
(74) *Attorney, Agent, or Firm* — Womble Carlyle Sandridge & Rice, LLP

(57) ABSTRACT

A mobile floor cleaning machine is provided, having a chassis on which running wheels are rotatably mounted, and having at least one cleaning unit which has at least one cleaning tool and is coupled to the chassis via a guide member. To improve the floor cleaning machine in such a way that the risk of damage to the floor cleaning machine or to an obstacle in the event of a frontal collision with the obstacle may be minimized, it is proposed that the guide member is elastically deformable in the longitudinal direction of the floor cleaning machine.

19 Claims, 6 Drawing Sheets

MOBILE FLOOR CLEANING MACHINE

CROSS-REFERENCE TO RELATED APPLICATIONS

This application is a continuation of international application number PCT/EP2010/067492, filed on Nov. 15, 2010, which is incorporated herein by reference in its entirety and for all purposes.

BACKGROUND OF THE INVENTION

The invention relates to a mobile floor cleaning machine, having a chassis on which running wheels are rotatably mounted, and having at least one cleaning unit which has at least one cleaning tool and is coupled to the chassis via a guide member.

These types of floor cleaning machines may be moved along a floor surface to be cleaned, whereby the floor surface may be cleaned by means of the at least one cleaning tool of the cleaning unit. For this purpose, the at least one cleaning tool is customarily rotatably drivable. These types of floor cleaning machines are known in the form of scrubbers, for example, in which the cleaning unit is configured as a brush head on which at least one scrubbing roller, which may be set in rotation about its rotational axis by a motor, is rotatably mounted.

The cleaning unit is coupled to the chassis via guiding members and lifting members. The cleaning unit may be moved back and forth between a raised position and a lowered position by means of the lifting member. In the raised position, the at least one cleaning tool of the cleaning unit is situated at a distance from the floor surface, and in the lowered position the at least one cleaning tool may work on the floor surface. The guide member is used to transmit thrust forces from the chassis to the cleaning unit during travel of the floor cleaning machine. The cleaning unit may be guided by the chassis of the floor cleaning machine by means of the guide member.

Mobile floor cleaning machines of the type stated at the outset are known from EP 0 705 559 A1 and EP 0 910 981 A1. For coupling the cleaning unit to the chassis, EP 0 705 559 A1 proposes the use of two connecting arms which are formed to be sufficiently rigid to guide the cleaning unit. For this purpose, EP 0 910 981 A1 proposes a parallelogram-type suspension having two pivot levers.

In the known configurations, difficulties arise in the event of a collision of the floor cleaning machine with an obstacle. Since the cleaning unit in many cases is situated at the front end of the floor cleaning machine in the direction of travel, frontal collision forces acting on the floor cleaning machine are transmitted from the cleaning unit to the chassis via the guide member. This may result in damage to the floor cleaning machine and also to the obstacle.

It is an object of the present invention to improve a mobile floor cleaning machine of the type mentioned at the outset in such a way that the risk of damage to the floor cleaning machine or to an obstacle in the event of a frontal collision with the obstacle may be minimized.

SUMMARY OF THE INVENTION

In a mobile floor cleaning machine of the generic kind, this object is achieved according to the invention in that the guide member is elastically deformable in the longitudinal direction of the floor cleaning machine.

In the floor cleaning machine according to the invention, the guide member forms a type of crumple zone which can elastically deform in the event of a frontal collision of the floor cleaning machine with an obstacle, and thus absorb impact forces which occur. The risk of damage to the floor cleaning machine or also to the obstacle which the floor cleaning machine strikes is thus reduced.

The function of the elastic deformation of the guide member may be achieved in that the guide member is made of an elastically deformable material. However, use of these types of materials has the disadvantage that they generally do not have high mechanical stability, and therefore precise guiding of the cleaning unit during the cleaning operation of the floor cleaning machine is not ensured in all cases. Therefore, it is particularly advantageous for the guide member to have a shape elastic configuration. In such an embodiment of the invention, the shape of the guide member may elastically change in the event of a frontal collision of the floor cleaning machine with an obstacle in order to limit impact forces which occur.

It may be provided, for example, that the guide member has at least one push bar with two bar arms inclined at an angle with respect to one another. In the event of a frontal collision, the free ends of the bar arms may approach one another due to elastic deformation.

The at least one push bar of the guide member preferably has a U-shaped or a V-shaped or a C-shaped configuration.

The two bar arms of the at least one push bar may be joined together in one piece. In particular, it may be provided that the at least one push bar is configured as a one-piece molded part. It may be provided, for example, that the at least one push bar is manufactured as a one-piece molded plastics part or also as a die-cast part made of an aluminum alloy.

In a particularly preferred embodiment of the floor cleaning machine according to the invention, the guide member includes two push bars which are fixedly connected to one another via a crossbar. By means of the two push bars, horizontal guide forces may be easily transmitted from the chassis to the cleaning unit, and the rigid coupling of the two push bars via the crossbar ensures that the guide member has high mechanical load capacity with regard to laterally acting forces.

The two push bars of the guide member are advantageously oriented parallel to one another. It may be provided, for example, that the two push bars each define a bar plane that is vertically oriented.

It is advantageous if the crossbar connects the end regions of the push bars facing the cleaning unit.

In a preferred embodiment of the invention, the guide member includes at least one front connecting element associated with the cleaning unit and at least one rear connecting element associated with the chassis, which interact to establish mechanical connections to corresponding connecting elements of the cleaning unit and of the chassis, respectively. The guide member may be connected to the chassis and to the cleaning unit by means of the front and rear connecting elements of the guide member and the associated connecting elements of the chassis and of the cleaning unit, respectively. The mechanical connections are preferably releasable. In particular, it may be provided that at least the mechanical connection between the chassis and the guide member may be established and separated without tools.

In addition to the connecting elements, the guide member advantageously has at least one first stop element which can abut face-to-face against an associated stop surface of the chassis. In the event of a frontal collision of the floor cleaning machine, collision forces can be transmitted from the guide member to the chassis via the at least one first stop element. The face-to-face abutment of the stop element against the stop surface reduces pressure forces that occur, and thus prevents the risk of damage to the guide member and/or to the chassis. The collision forces may thus be transmitted from the guide member to the chassis, independently of the rear connecting element of the guide member and independently of the connecting element of the chassis associated with the rear connecting element. The risk of damage to the connecting elements in the event of a frontal collision of the floor cleaning machine may thus be kept particularly low.

It is advantageous if the at least one connecting element of the chassis has a first receptacle and a first stop surface facing away from the first receptacle, whereby a rear connecting element of the guide member may be inserted into the first receptacle, and a first stop element of the guide member may abut against the first stop surface. The at least one connecting element of the chassis may be configured, for example, in the manner of a hook which protrudes from a base part, and which in combination with the base part forms a receptacle into which a rear connecting element of the guide member may be inserted. An end face of the hook facing the cleaning unit may form a first stop surface against which a first stop element of the guide member, situated at a distance from the rear connecting element, may abut in face-to-face manner.

It is particularly advantageous if the rear connecting element of the guide member is insertable into the first receptacle without tools. This simplifies the assembly of the floor cleaning machine.

It is advantageous if the first receptacle opens in the direction facing away from the cleaning unit. The rear connecting element of the guide member may thus be easily inserted into the receptacle from the rear. The receptacle may have a U-shaped configuration, for example.

The at least one rear connecting element of the guide member is preferably configured as a rear bearing pin which extends between two prongs of a rear bearing yoke of the guide member.

The two prongs of the rear bearing yoke and the rear bearing pin are preferably joined together in one piece. It may thus be provided, for example, that the rear bearing yoke is configured as a one-piece molded plastics part.

It is particularly advantageous if the guide member has two rear connecting elements which are configured as rear bearing pins oriented in alignment with one another. In such an embodiment, the guide member has two rear bearing yokes, each having two prongs between which a rear bearing pin extends. The two rear bearing pins are oriented in alignment with one another, and in each case are used for mechanically connecting the guide member to the chassis of the floor cleaning machine.

A pivotable mounting of the guide member on the chassis is achievable via the at least one rear bearing pin in a structurally simple manner.

In an advantageous embodiment of the invention, the at least one connecting element of the cleaning unit has a second receptacle into which a front connecting element of the guide member is insertable.

It is advantageous if a securing element, which engages behind the front connecting element that is inserted into the second receptacle, projects into the second receptacle. The securing element may be configured in the form of a securing pin, for example. This allows the front connecting element of the guide member to be inserted into the second receptacle in a first installation step, and the securing element to be subsequently inserted into the second receptacle in a second installation step, the securing element engaging behind the second connecting element and thus ensuring that the front connecting element cannot be inadvertently separated from the second receptacle.

The second receptacle advantageously opens at an angle with respect to the vertical in the direction facing the floor surface to be cleaned. This provides the option of inserting the second connecting element into the second receptacle at an angle from below in order to establish a mechanical connection between the guide member and the cleaning unit.

The second receptacle advantageously has a C-shaped configuration.

In an advantageous embodiment of the invention, the at least one front connecting element is configured as a front bearing pin which extends between two prongs of a front bearing yoke of the guide member. This allows easy assembly of the floor cleaning machine, and also ensures a pivotable mounting of the guide member on the cleaning unit in a structurally simple manner.

It is advantageous if the guide member has two front connecting elements which are configured as front bearing pins oriented in alignment with one another. For this purpose, the guide member may have two front bearing yokes, each having two prongs between which a front bearing pin extends.

In an advantageous embodiment, a particularly high mechanical load capacity of the guide member is achieved in that the guide member has two front connecting elements and two rear connecting elements, which front and rear elements are situated at the corners of an imaginary rectangle. In this type of configuration, one front connecting element and one rear connecting element in each case may be oriented in alignment with one another in the direction of travel of the floor cleaning machine, and in addition the respective front connecting elements, and likewise the rear connecting elements, may be oriented in alignment with one another transverse to the direction of travel of the floor cleaning machine.

It is advantageous if the guide member has at least one second stop element which can abut against a second stop surface of the chassis in the event of an elastic deformation of the guide member. In this type of configuration, the guide member includes at least one first stop element, and in addition at least one second stop element. In the event of a frontal collision of the floor cleaning machine, collision forces may be transmitted to the chassis via the two stop elements without the risk of the collision forces which occur resulting in damage to the connecting elements of the guide member, of the cleaning unit, and/or of the chassis.

It may be provided, for example, that the at least one second stop element is situated between a first stop element and a front connecting element of the guide member.

As mentioned above, it may be provided that the guide member has at least one front bearing yoke and at least one rear bearing yoke, each having two prongs between which a bearing pin extends. The bearing yokes may in each case have a mounting web which joins the two prongs together and forms a stop element which can abut against a stop surface of the chassis.

In a preferred embodiment, the at least one second stop surface of the chassis is situated on a bearing block of the chassis. The bearing block may, for example, support a drive motor of the floor cleaning machine or also an axle of the floor cleaning machine.

The chassis advantageously includes two bearing blocks, each forming a second stop surface.

As mentioned above, it is advantageous if the guide member has two push bars which are connected to one another via a crossbar. Two bearing blocks of the chassis, each forming a second stop surface, are advantageously situated between the two push bars, and at their end regions facing the cleaning unit the two push bars each carry a bearing yoke with a mounting web forming a second stop element which can abut against a second stop surface. The crossbar which connects the two push bars to one another is advantageously oriented in alignment with the mounting webs of the two front bearing yokes.

The following description of a preferred embodiment of the invention is used to explain the invention in greater detail in conjunction with the drawings.

DETAILED DESCRIPTION OF THE INVENTION

Figure 1:
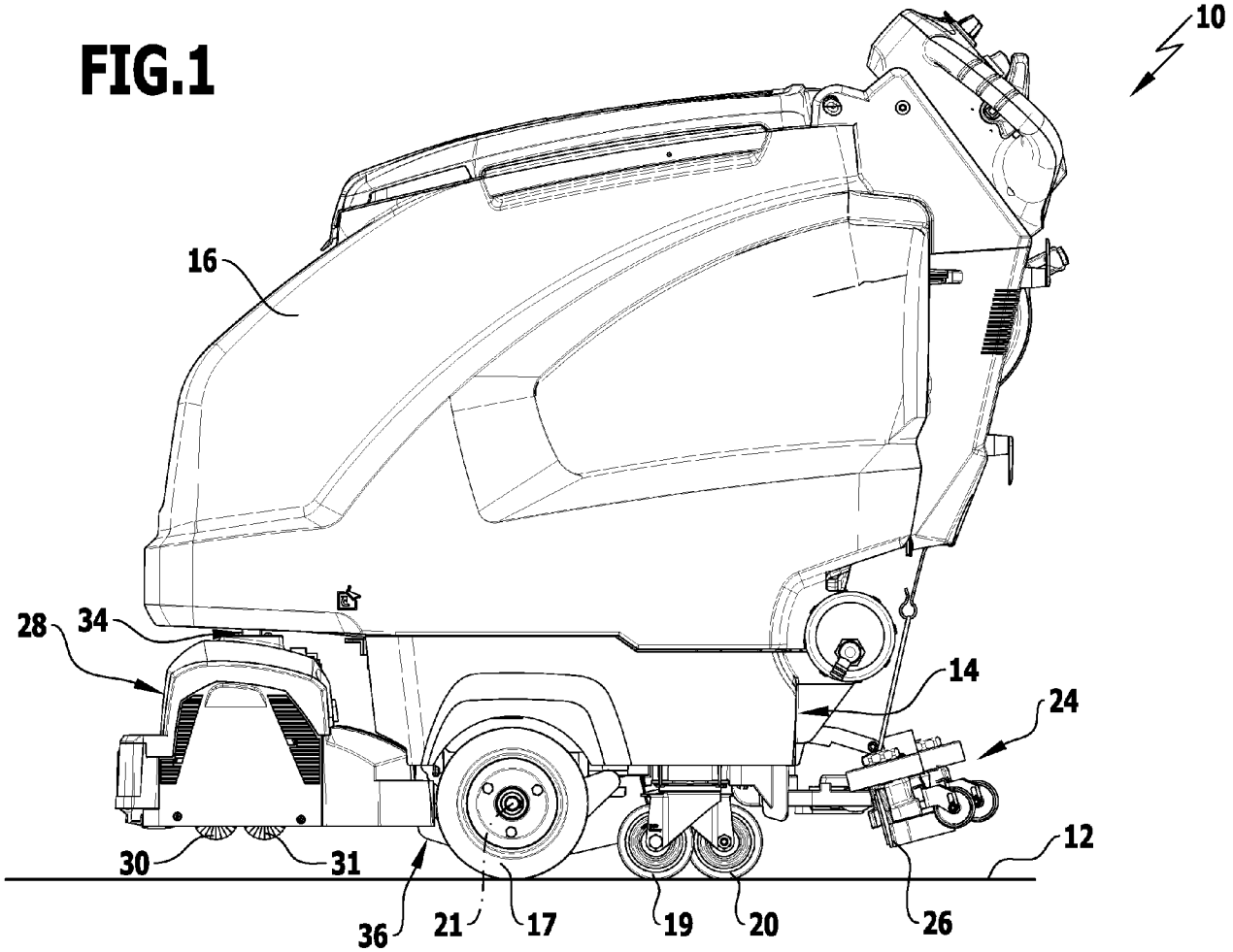
FIG. 1 shows a schematic side view of a mobile floor cleaning machine, having a chassis and a cleaning unit which is connected to the chassis via guide and lifting members.

The drawing schematically illustrates a mobile floor cleaning machine according to the invention, using the example of a scrubber 10 which may be moved along a floor surface 12 in order to clean the floor surface 12. The scrubber 10 has a chassis 14 which carries a housing 16 and on which running wheels 17, 18, 19, 20 are rotatably mounted. The two front running wheels 17 and 18 are connected to one another via a common axle 21.

The housing 16 accommodates a conventional cleaning fluid tank known to those skilled in the art and therefore not illustrated in the drawing, as well as a dirty liquid tank, which is likewise known and not illustrated in the drawing. A cleaning fluid, preferably water, for cleaning the floor surface 12, may be kept in the cleaning fluid tank, and the dirty liquid tank may be acted on with negative pressure by a suction unit of the scrubber 10, likewise known and therefore not illustrated in the drawing. The dirty liquid tank is in flow connection with a suction bar 24, situated on the chassis 14, via a suction line which is not illustrated in the drawing. The suction bar 24 has a suction lip 26, and may be moved back and forth between its raised position, illustrated in FIG. 1, and a lowered position not illustrated in the drawing. In the lowered position, the suction lip 26 engages with the floor surface 12.

Figure 2:
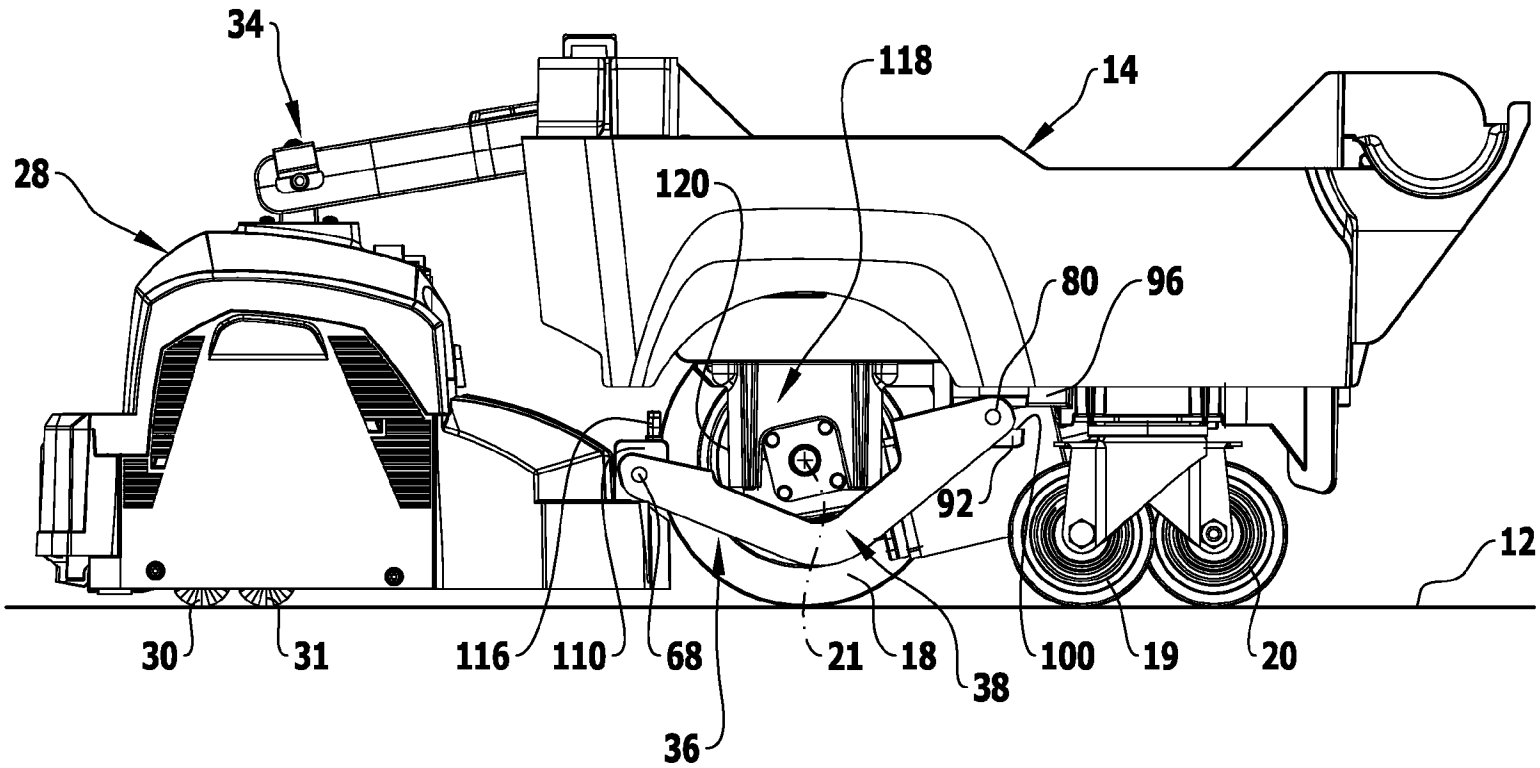
FIG. 2 shows an enlarged side view of the chassis and the cleaning unit.

Beneath the housing 16, a cleaning unit in the form of a brush head 28 and having two cleaning tools in the form of a first scrubbing roller 30 and a second scrubbing roller 31 is situated in front of the chassis 14. The brush head 28 is connected to the chassis 14 via a lifting member 34 which engages on the brush head 28 from above, and a guide member 36 which engages on the brush head 28 at the rear. The brush head 28 may be moved back and forth between a raised position illustrated in FIG. 1 and a lowered position illustrated in FIG. 2 by means of the lifting member 34. In the lowered position, the two scrubbing rollers 30 and 31 engage on the floor surface 12 in order to clean same. In the raised position, the scrubbing rollers 30 and 31 are situated at a distance from the floor surface 12.

The brush head 28 may be guided by the chassis 14 by means of the guide member 36, so that the brush head 28 follows the movement of the chassis 14. For this purpose, thrust forces may be transmitted from the chassis 14 to the brush head 28 via the guide member 36.

Figure 5:
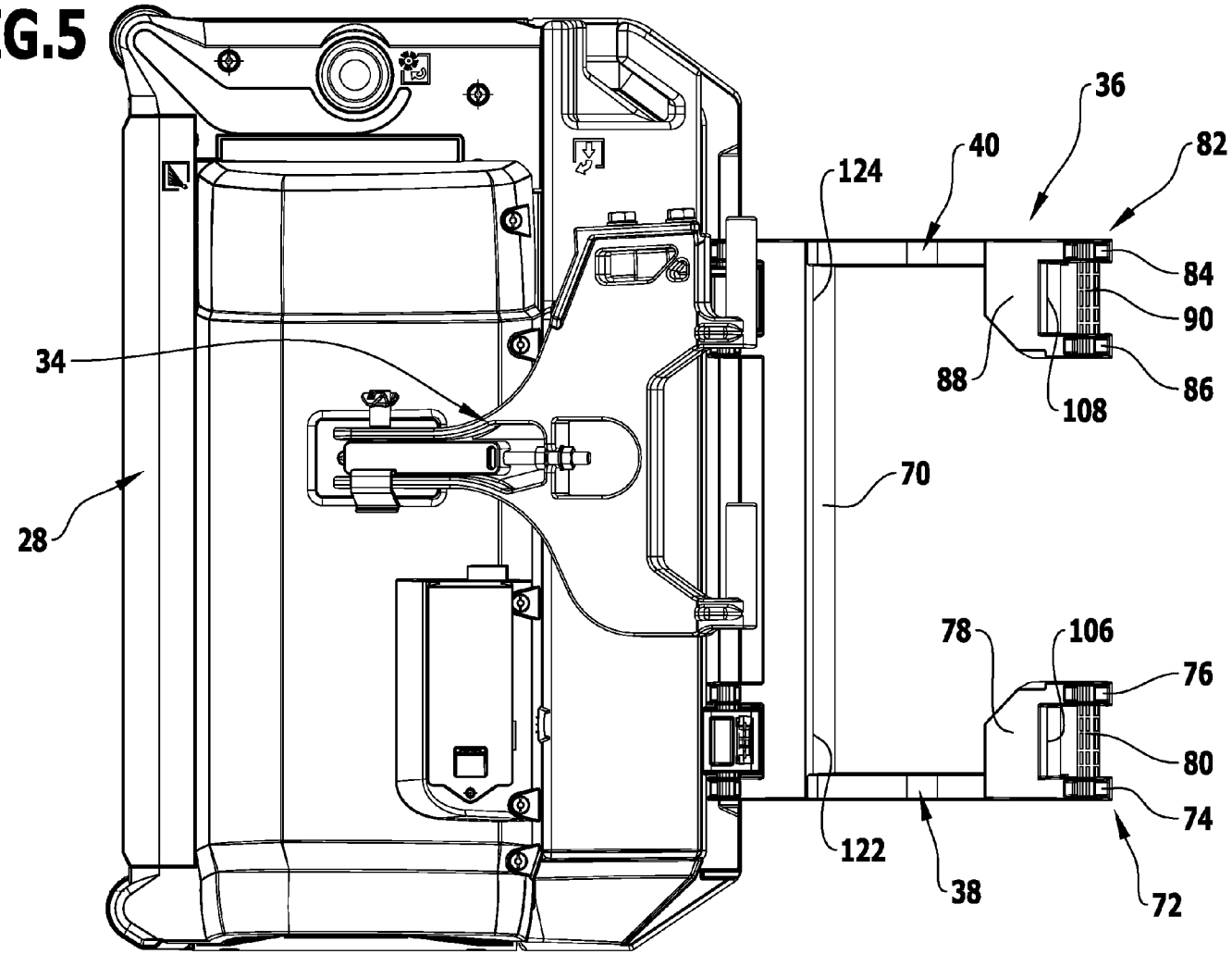
FIG. 5 shows a schematic top view of the cleaning unit and the guide member.
Figure 6:
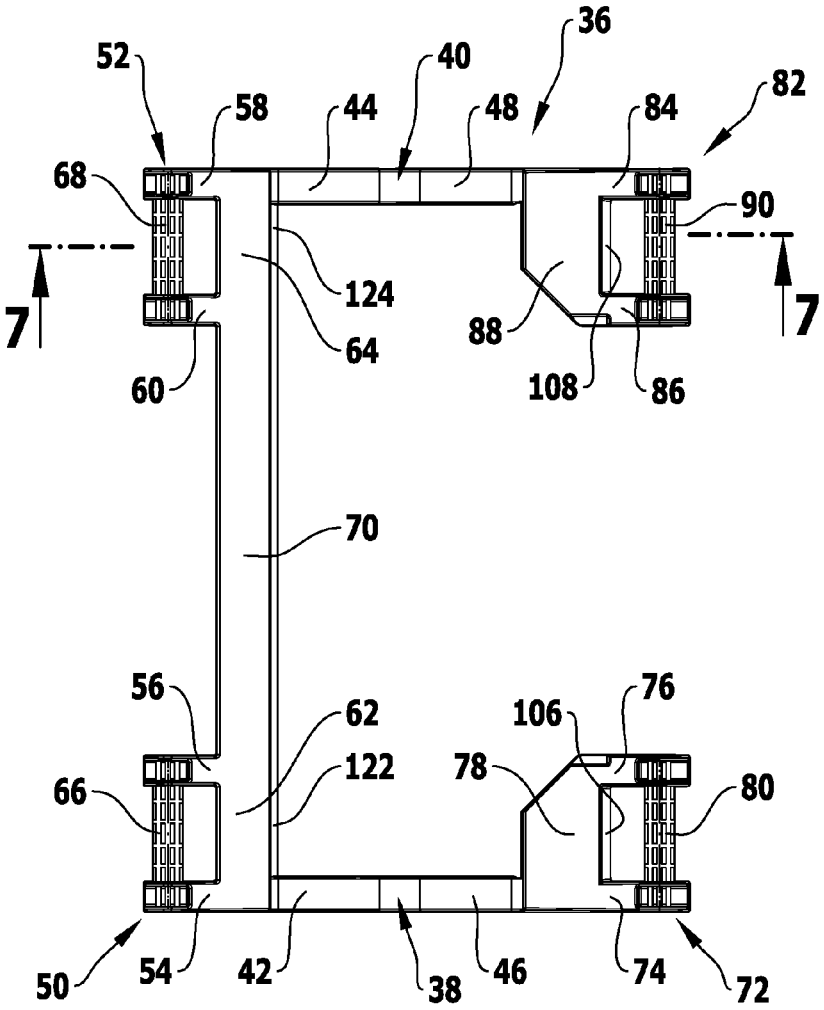
FIG. 6 shows a top view of the guide member.
Figure 7:
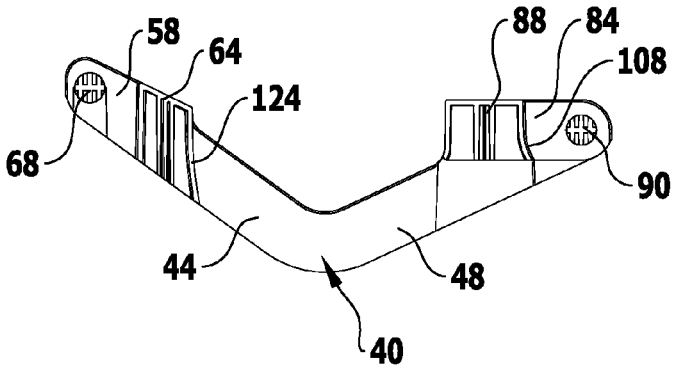
FIG. 7 shows a sectional view of the guide member along the line 7-7 in FIG. 6.

As is particularly apparent from FIGS. 5 and 6, the guide member 36 includes a first push bar 38 and a second push bar 40. The two push bars 38, 40 have an identical configuration, and each has a front bar arm 42 and 44, respectively, and a rear bar arm 46 and 48, respectively. The respective bar arms 42 and 46, and 44 and 48, are each joined together in one piece and inclined at an angle with respect to one another. In the illustrated exemplary embodiment, the front and rear bar arms are oriented in a V shape at an angle of approximately 120° with respect to one another.

The front bar arm 42 of the first push bar 38 carries a first front bearing yoke 50 at its front end, and the front bar arm 44 of the second push bar 40 carries a second front bearing yoke 52 at its front end. The two front bearing yokes 50, 52 have an identical configuration. The front bearing yokes each include two prongs 54, 56 and 58, 60, respectively, which are joined together in one piece via a mounting web 62, 64, respectively, and between which a front bearing pin 66 and 68, respectively, extends. The two front bearing pins 66, 68 are in alignment with one another, and the front mounting webs 62 and 64 are also in alignment with one another. A crossbar 70 extends between the mounting webs 62, 64 in alignment with the mounting webs 62, 64, the two push bars 38, 40 being fixedly connected to one another via the crossbar.

The rear bar arm 46 of the first push bar 38 carries a first rear bearing yoke 72 at its free end, with two prongs 74, 76 which are fixedly joined together via a first rear mounting web 78, and between which a rear bearing pin 80 extends. Correspondingly, a second rear bearing yoke 82 is situated at the free end of the rear bar arm 48 of the second push bar 60, with two prongs 84, 86 which are joined together in one piece via a second rear mounting web 88, and between which a second rear bearing pin 90 extends.

Figure 3:
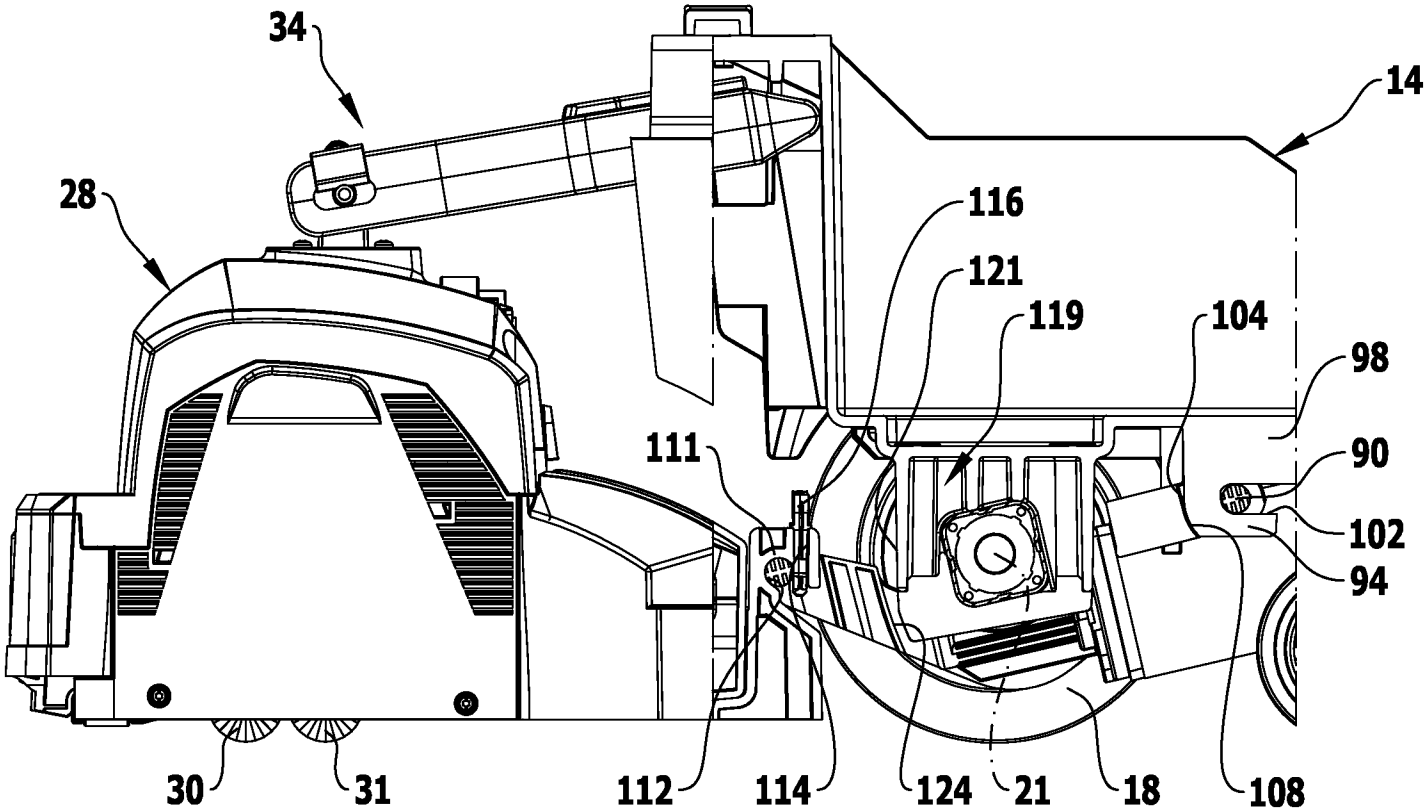
FIG. 3 shows a partially cutaway side view of the chassis and the cleaning unit.
Figure 4:
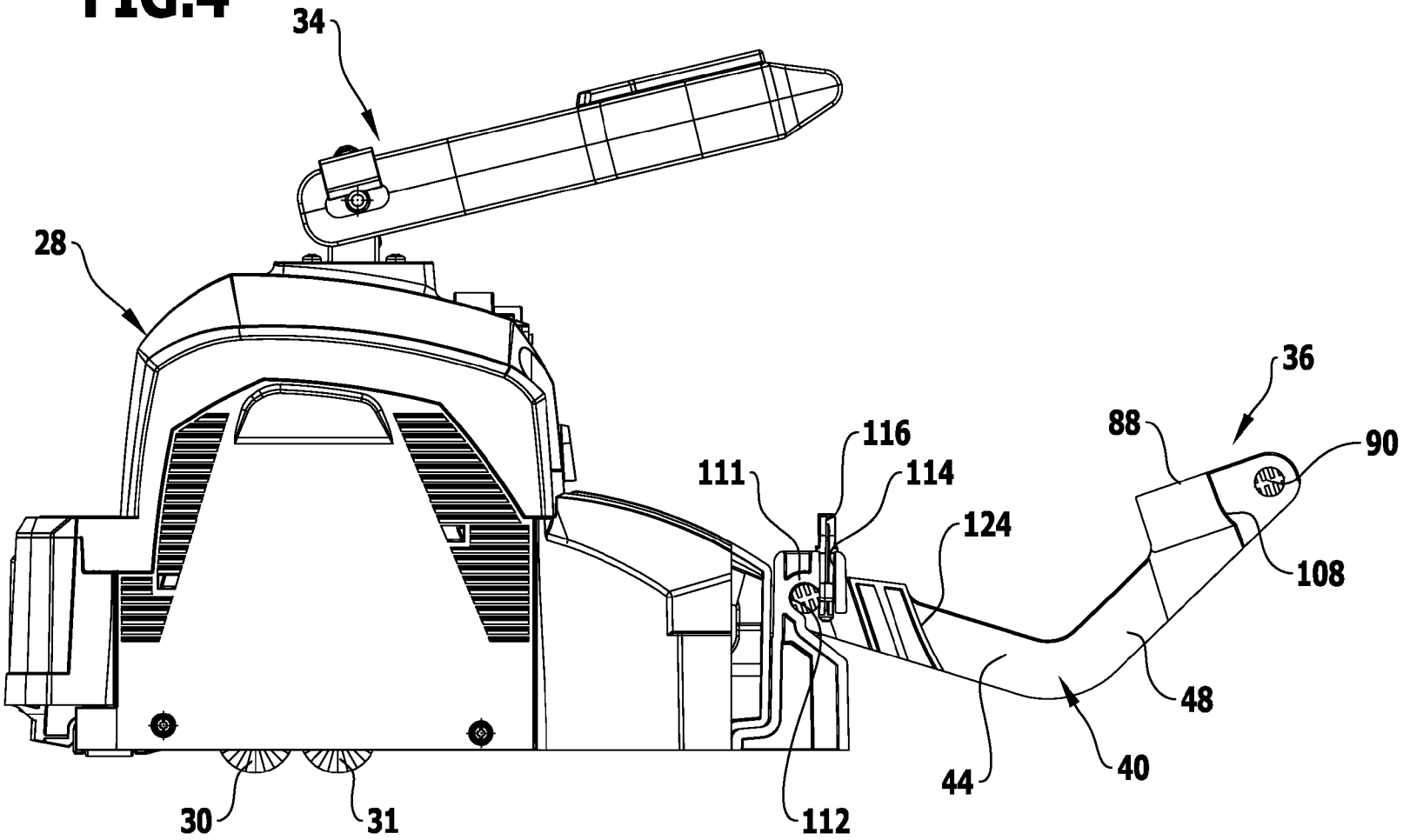
FIG. 4 shows a partially cutaway side view of the cleaning unit and the guide member.

The rear bearing pins 80, 90 in each case form a rear connecting element of the guide member 36. Each of the rear bearing pins interacts with a corresponding connecting element of the chassis 14. For this purpose, the chassis 14 has two connecting hooks 92 and 94, which in each case protrude from a base part 96 and 98, respectively, and which define first receptacles 100 and 102, respectively. The first receptacles 100, 102 have a U-shaped configuration, and open horizontally to the rear in the direction facing away from the brush head 28. This is apparent in particular from FIG. 3. A rear bearing pin 80 and 90 may be inserted into the first receptacles 100, 102, respectively. For inserting the bearing pins 80, 90 into the first receptacles 100, 102 when the scrubber 10 is raised from the floor surface 12, the guide member 36 may initially be oriented substantially perpendicularly with respect to the chassis 14. After the rear bearing pins 80, 90 have been inserted, the guide member 36 may then be pivoted forwardly about the bearing pins 80, 90 until the connecting hook 92 or 94, respectively, with its end face 104 which faces the brush head 28 abuts face-to-face against a front contact surface 106 or 108 of the first rear mounting web 78 or the second rear mounting web 88, respectively. The end faces 104 of the connecting hooks 92, 94 thus each form a first stop surface, and the two rear mounting webs 78 and 88 each define a first stop element which may abut in face-to-face manner against the respective first stop surfaces.

The front bearing pins 66 and 68 form front connecting elements of the guide member 36, and in each case interact with a second receptacle 112 situated on the brush head 28.

For this purpose, the brush head 28 has two identically configured connecting elements 110, 111, each defining a substantially C-shaped second receptacle 112 into which a front bearing pin 66 or 68, respectively, may be inserted at an angle from below. At the side of the second receptacle 112, the connecting elements 110, 111 each have a vertically oriented through channel 114 through which a securing pin 116 extends. With its end region which protrudes downwardly from the through channel 114 toward the floor surface 12, the securing pin 116 engages behind the front bearing pin 66 and 68, respectively, which is inserted into the second receptacle 112, so that the front bearing pin is secured in the second receptacle 112.

A releasable mechanical connection between the guide member 36 and the brush head 28 is ensured by means of the connecting elements 110, 111 and the front bearing pins 66, 68, the brush head being pivotable relative to the guide member 36 about the mutually aligned front bearing pins 66, 68.

Similarly, a releasable mechanical connection between the guide member 36 and the chassis 14 is ensured by the connecting hooks 92, 94 and the rear bearing pins 80, 90, the guide member 36 being pivotable about the mutually aligned rear bearing pins 80, 90.

The chassis 14 has two downwardly protruding bearing blocks 118, 119 between the two push bars 38, 40 of the guide member 36. The bearing blocks 118, 119 are used for mounting the axle 21 of the two front running wheels 17 and 18, respectively. Alternatively, in each case a drive motor for the running wheels 17, 18 may be supported on the bearing blocks 118. With their front sides facing the brush head 28, the bearing blocks 118, 119 form a second stop surface 120, 121, respectively, against which a rear contact surface 122 and 124 of the front mounting webs 62 and 64, respectively, may abut in face-to-face manner. The front mounting webs 62, 64 thus form second stop elements of the guide member 36 which can abut against the second stop surfaces 120, 121 of the bearing blocks 118, 119, respectively.

The guide member 36 is configured as a one-piece molded plastics part. The guide member is preferably made of a foamed polypropylene material. Guide forces may be transmitted from the chassis 14 to the brush head 28 via the guide member 36 during normal operation of the scrubber 10. The guide member 36 allows a pivotable mounting of the brush head 28 on the chassis 14, so that the brush head 28 may follow any unevennesses of the floor surface 12.

In the event of a frontal collision of the scrubber 10 with an obstacle, the collision forces may be transmitted from the guide member 36 to the end faces 104 of the connecting hooks 92, 94 via the rear mounting webs 78 and 88, respectively, without the rear bearing pins 80, 90 experiencing mechanical stress. The two push bars 38 and 40 may be elastically deformed until the rear contact surfaces 122, 124 of the front mounting webs 62, 64, respectively, make contact with the second stop surface 120, 121 of a bearing block 118 or 119, respectively. This allows an additional transmission of frontally acting collision forces to the chassis 14.

The guide member 36 may be installed on the chassis 14 and on the brush head 28 very easily. As explained above, the rear bearing pins 80, 90 may be inserted into the first receptacles 100 and 102 of the connecting hooks 92 and 94, respectively, without using a tool, and the front bearing pins 66, 68 may be inserted into the second receptacles 112 of the connecting elements 110, 111, respectively, at an angle from below, after the respective securing pins 116 are disengaged. Inadvertent disengagement of the front bearing pins 66, 68 from the second receptacles 112 may be easily prevented by inserting the securing pins 116.

That which is claimed:

1. A mobile floor cleaning machine having a chassis on which running wheels are rotatably mounted, and having at least one cleaning unit which has at least one cleaning tool and is coupled to the chassis via a guide member, wherein the guide member is elastically deformable in a longitudinal direction of the floor cleaning machine;

wherein the guide member has at least one front connecting element associated with the cleaning unit and at least one rear connecting element associated with the chassis, which interact to establish mechanical connections to corresponding connecting elements of the cleaning unit and of the chassis, respectively;

wherein the guide member has at least one first stop element which can abut face-to-face against a first stop surface of the chassis; and wherein at least one connecting element of the chassis has a first receptacle and a first stop surface facing away from the first receptacle, a rear connecting element of the guide member being insertable into the first receptacle.

2. The floor cleaning machine according to claim 1, wherein the guide member has a shape elastic configuration.

3. The floor cleaning machine according to claim 1, wherein the guide member has at least one push bar with two bar arms inclined at an angle with respect to one another.

4. The floor cleaning machine according to claim 3, wherein the at least one push bar has a U-shaped or a V-shaped or a C-shaped configuration.

5. The floor cleaning machine according to claim 3, wherein the guide member has two push bars which are fixedly connected to one another via a crossbar.

6. The floor cleaning machine according to claim 5, wherein the two push bars are oriented parallel to one another.

7. The floor cleaning machine according to claim 5, wherein each push bar comprises an end region facing the cleaning unit and wherein the crossbar connects the end region of each push bar.

8. The floor cleaning machine according to claim 1, wherein a rear connecting element of the guide member is insertable into the first receptacle without tools.

9. The floor cleaning machine according to claim 1, wherein the first receptacle opens in a direction facing away from the cleaning unit.

10. The floor cleaning machine according to claim 1, wherein the at least one rear connecting element of the guide member is configured as a rear bearing pin which extends between two prongs of a rear bearing yoke of the guide member.

11. The floor cleaning machine according to claim 10, wherein the guide member has two rear connecting elements which are configured as rear bearing pins oriented in alignment with one another.

12. A mobile floor cleaning machine having a chassis on which running wheels are rotatably mounted, and having at least one cleaning unit which has at least one cleaning tool and is coupled to the chassis via a guide member, wherein the guide member is elastically deformable in a longitudinal direction of the floor cleaning machine;

wherein the guide member has at least one front connecting element associated with the cleaning unit and at least one rear connecting element associated with the chassis, which interact to establish mechanical connections to corresponding connecting elements of the cleaning unit and of the chassis, respectively;

wherein the guide member has at least one first stop element which can abut face-to-face against a first stop surface of the chassis;

wherein at least one connecting element of the cleaning unit has a second receptacle into which a front connecting element of the guide member is insertable; and wherein the second receptacle opens at an angle with respect to vertical in a direction facing the floor surface to be cleaned.

13. A mobile floor cleaning machine having a chassis on which running wheels are rotatably mounted, and having at least one cleaning unit which has at least one cleaning tool and is coupled to the chassis via a guide member, wherein the guide member is elastically deformable in a longitudinal direction of the floor cleaning machine;

wherein the guide member has at least one front connecting element associated with the cleaning unit and at least one rear connecting element associated with the chassis, which interact to establish mechanical connections to corresponding connecting elements of the cleaning unit and of the chassis, respectively;

wherein the guide member has at least one first stop element which can abut face-to-face against a first stop surface of the chassis; and wherein the guide member has two front connecting elements and two rear connecting elements, which front and rear connecting elements are situated at corners of an imaginary rectangle.

14. A mobile floor cleaning machine having a chassis on which running wheels are rotatably mounted, and having at least one cleaning unit which has at least one cleaning tool and is coupled to the chassis via a guide member, wherein the guide member is elastically deformable in a longitudinal direction of the floor cleaning machine;

wherein the guide member has at least one front connecting element associated with the cleaning unit and at least one rear connecting element associated with the chassis, which interact to establish mechanical connections to corresponding connecting elements of the cleaning unit and of the chassis, respectively;

wherein the guide member has at least one first stop element which can abut face-to-face against a first stop surface of the chassis; and wherein the guide member has at least one second stop element which can abut against a second stop surface of the chassis in the event of an elastic deformation of the guide member.

15. The floor cleaning machine according to claim 12, wherein a securing element, which engages behind the front connecting element that is inserted into the second receptacle, projects into the second receptacle.

16. The floor cleaning machine according to claim 12, wherein the at least one front connecting element is configured as a front bearing pin which extends between two prongs of a front bearing yoke of the guide member.

17. The floor cleaning machine according to claim 16, wherein the guide member has two front connecting elements which are configured as front bearing pins oriented in alignment with one another.

18. The floor cleaning machine according to claim 14, wherein the at least one second stop element is situated between a first stop element and a front connecting element of the guide member.

19. The floor cleaning machine according to claim 14, wherein the chassis has at least one bearing block on which a second stop surface is situated.

* * * * *